US009694216B2

(12) United States Patent
Hyde et al.

(10) Patent No.: US 9,694,216 B2
(45) Date of Patent: Jul. 4, 2017

(54) AIR FILTERING DEVICES AND METHODS

(71) Applicant: Elwha LLC, Bellevue, WA (US)

(72) Inventors: Roderick A. Hyde, Redmond, WA (US); Jordin T. Kare, Seattle, WA (US); Tony S. Pan, Bellevue, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 218 days.

(21) Appl. No.: 14/533,678

(22) Filed: Nov. 5, 2014

(65) Prior Publication Data

US 2016/0121144 A1 May 5, 2016

(51) Int. Cl.

| | |
|---|---|
| ***A62B 7/10*** | (2006.01) |
| ***A62B 9/00*** | (2006.01) |
| ***A62B 23/06*** | (2006.01) |
| ***A62B 23/02*** | (2006.01) |

(52) U.S. Cl.
CPC ..... *A62B 7/10* (2013.01); *A62B 23/025* (2013.01); *A62B 23/06* (2013.01)

(58) Field of Classification Search
CPC combination set(s) only.
See application file for complete search history.

(56) References Cited

U.S. PATENT DOCUMENTS 3,884,223 A 5/1975 Keindl
5,647,890 A * 7/1997 Yamamoto ..... B03C 3/155 95/69
6,623,544 B1 9/2003 Kaura
6,901,930 B2 * 6/2005 Henley ..... A62B 23/025 128/201.22
6,971,387 B2 12/2005 Michaels
7,392,806 B2 7/2008 Yuen et al.
7,918,225 B2 4/2011 Dolezal et al.
2003/0136408 A1 * 7/2003 Henley ..... A62B 23/025 128/205.29
2004/0216745 A1 11/2004 Yuen et al.
2005/0061325 A1 3/2005 Michaels
2005/0161046 A1 7/2005 Michaels
2006/0254592 A1 11/2006 Anders et al.
2008/0023007 A1 1/2008 Dolezal et al.
2008/0110469 A1 5/2008 Weinberg
2009/0277451 A1 11/2009 Weinberg
2010/0282083 A1 * 11/2010 Edwards ..... B01D 46/0028 95/285
2011/0126828 A1 * 6/2011 Wu ..... A62B 7/10 128/201.25
2011/0174158 A1 7/2011 Walls et al.

* cited by examiner

*Primary Examiner* — Amber R Orlando
*Assistant Examiner* — Sonji Turner
(74) *Attorney, Agent, or Firm* — Foley & Lardner LLP

(57) ABSTRACT

A face mask includes an electrostatically-precipitating filter configured to be removably coupled to a face of a user, a controller operatively coupled to the electrostatically-precipitating filter, and a fastening member configured to removably couple the electrostatically-precipitating filter to the face of the user. The controller is configured to selectively control operation of the electrostatically-precipitating filter in response to an input received by the controller.

13 Claims, 9 Drawing Sheets

AIR FILTERING DEVICES AND METHODS

BACKGROUND

Air filtering devices such as surgical masks (sometimes referred to as hygiene masks, procedure masks, etc.) are often worn by users to, for example, protect the user's mouth and nose from undesirable airborne particles such as bacteria, airborne diseases, and the like. Typically, a mask covers the user's mouth and/or nose and is held in place by a strap, band, or a similar fastening member.

SUMMARY

One embodiment relates to a face mask. The face mask includes an electrostatically-precipitating filter configured to be removably coupled to a face of a user. The face mask also includes a controller operatively coupled to the electrostatically-precipitating filter, and a fastening member for securing the electrostatically-precipitating filter to the face of the user. The controller is configured to selectively control operation of the electrostatically-precipitating filter in response to an input received by the controller.

Another embodiment relates to an air filter device. The air filter device includes an electrostatically-precipitating filter configured to be removably coupled to a user. The electrostatically-precipitating filter includes a plurality of filter layers. The air filter device also includes a controller operatively coupled to the electrostatically-precipitating filter. The controller is configured to selectively control operation of the electrostatically-precipitating filter in response to an input received by the controller.

Yet another embodiment relates to a method for filtering air. The method includes coupling a face mask to a face of a user. The face mask includes an electrostatically-precipitating filter. The method further includes receiving an input indicative of an ambient air pollution level at a controller, and controlling, by the controller, operation of the electrostatically-precipitating filter based on the input.

Yet another embodiment relates to a method for filtering air. The method includes coupling an air filter device to at least one of a nose and a mouth of a user. The air filter device includes an electrostatically-precipitating filter. The method further includes receiving an input indicative of an ambient air pollution level at a controller, and controlling, by the controller, operation of the electrostatically-precipitating filter based on the input.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
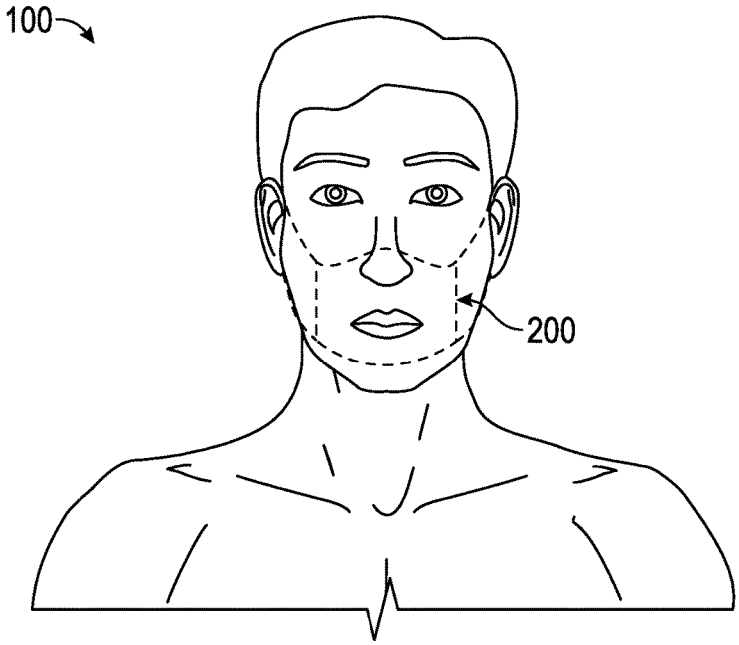
FIGS. 1A-1B illustrate a face mask according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring generally to the figures, disclosed herein are air filtering devices and methods for filtering air that provide active (e.g., adaptive) protection to a user from ambient airborne particles. In various embodiments, the air filtering devices include an electrostatically-precipitating filter that is feedback controlled to provide active/adaptive protection to a user based on various inputs. In one embodiment, the air filtering device includes an electrostatically-precipitating filter that is actively controlled based on a published or otherwise known ambient air pollution count/level for a particular day (e.g., an airborne particle count). The air filtering device can download and/or lookup published air pollution levels from the Internet via wireless communication, and can actively control/adjust the filter to capture airborne particles based on the air pollution level.

In one embodiment, the air filtering device includes a sensor operatively (e.g., electrically) coupled to an electrostatically-precipitating filter. The sensor is configured to detect an airflow condition proximate the filter, such as the number of particles passing through entering or leaving the filter, the concentration of particles entering or leaving the filter, the type of particles entering or leaving the filter, and/or the size distribution of particles entering or leaving the filter. The air filtering device can analyze the condition detected by the sensor and can actively control/adjust the filter to capture more or fewer airborne particles in response to the detected condition. In other embodiments, the air filtering device includes a memory for storing information relating to a condition detected by the sensor. The information can be wirelessly transmitted to a communication device for a user to retrieve. The information may provide the user with an indication of the total number of particles passing through or captured by the filter or ambient airborne particle levels. The transmitted information may be used to determine when to clean/replace the filter and/or to otherwise assess the status of the filter.

In various embodiments, the air filtering device may be configured to capture airborne particles passing/entering into at least one of a user's nose and mouth. In one embodiment, the air filtering device is in the form of a face mask configured to cover at least one of a user's nose and mouth. In another embodiment, the air filtering device is in the form of an insertable member configured to be inserted (e.g., implanted) into at least one of a user's nasal cavity (e.g., nostrils) or a user's mouth for filtering/capturing airborne particles. In various embodiments, the face mask and the insertable member(s) may be used independently of each other or in combination with each other to provide varying degrees of protection from ambient airborne particles.

Figure 1B:
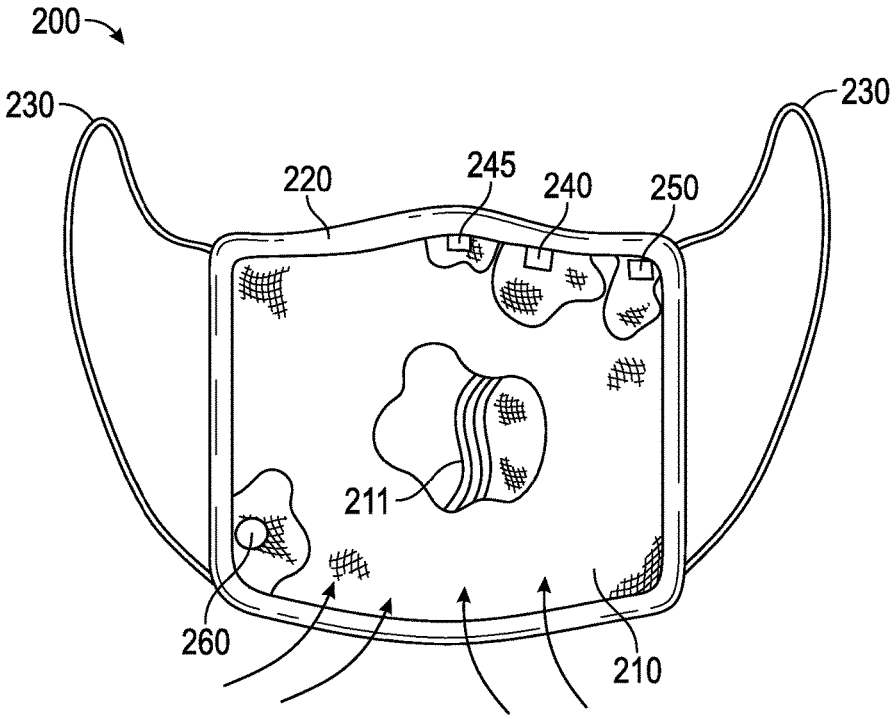
Figure 2A:
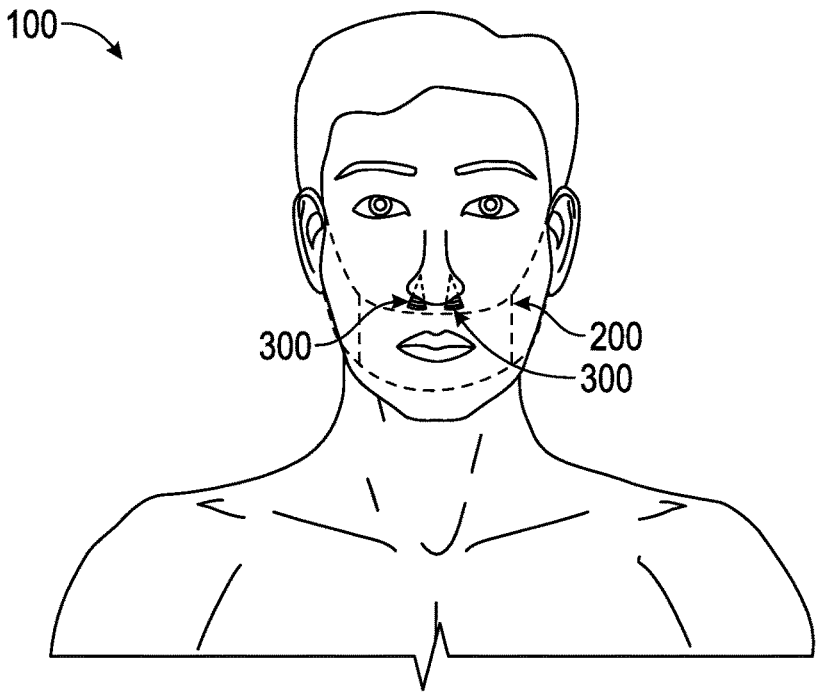
FIGS. 2A-2C illustrate a nasally insertable member according to another embodiment.

Referring now to FIGS. 1A-1B, in one embodiment, an air filtering device in the form of face mask 200 is shown removably coupled to the face of user 100. In this embodiment, face mask 200 covers the nose and mouth of user 100. In another embodiment shown in FIG. 2A, face mask 200 covers only the mouth of user 100. In both embodiments, face mask 200 includes air permeable filter member 210 for filtering/capturing airborne particles. In some embodiments, face mask 200 further includes seal member 220 for sealingly engaging face mask 200 to the face of user 100, thereby providing an airtight seal between face mask 200 and user 100. As shown in FIG. 2A, seal 220 is located along a peripheral edge of filter member 210. Face mask 200 may further include a fastening member in the form of strap 230 for removably coupling face mask 200 to user 100. In other embodiments (not shown), face mask 200 may be removably coupled using other types of fastening devices suitable for retaining face mask 200 on the face of user 100.

Figure 2B:
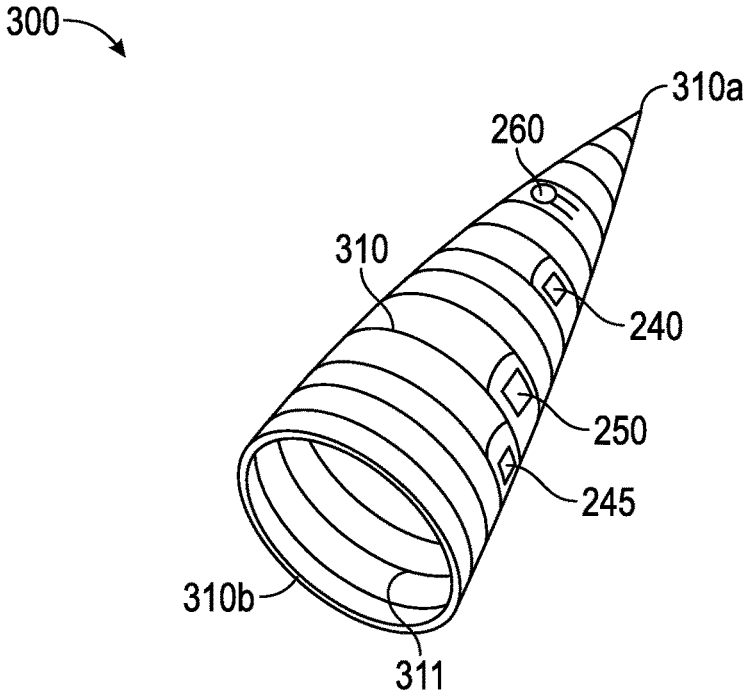
Figure 2C:
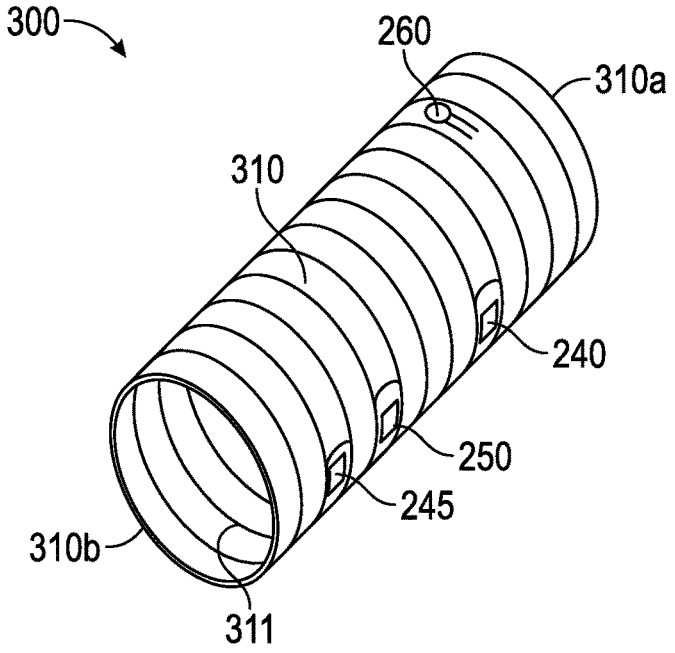

In another embodiment shown in FIGS. 2A-2C, an air filtering device in the form of insertable member 300 is shown removably coupled (e.g., inserted, implanted, etc.) to each nasal cavity of user 100. Insertable member 300 may be coupled to a nasal cavity of user 100 by virtue of an interference or snug fit between insertable member 300 and a portion of the nasal cavity (i.e., nostril). In other embodiments, insertable member 300 may be coupled to user 100 using a strap, a clip, and/or any other suitable member for securing insertable member 300 to user 100. As shown in FIGS. 2A-2C, insertable member 300 includes air permeable filter member 310. In one embodiment shown in FIG. 2B, air permeable filter member 310 has a conical shape. In other embodiments, air permeable filter member has an at least frusto-conical shape. In another embodiment shown in FIG. 2C, air permeable filter member 310 has a cylindrical shape. In both embodiments shown in FIGS. 2B-2C, air-permeable filter member 310 includes proximal end 310*a* and distal end 310*b*.

Figure 3A:
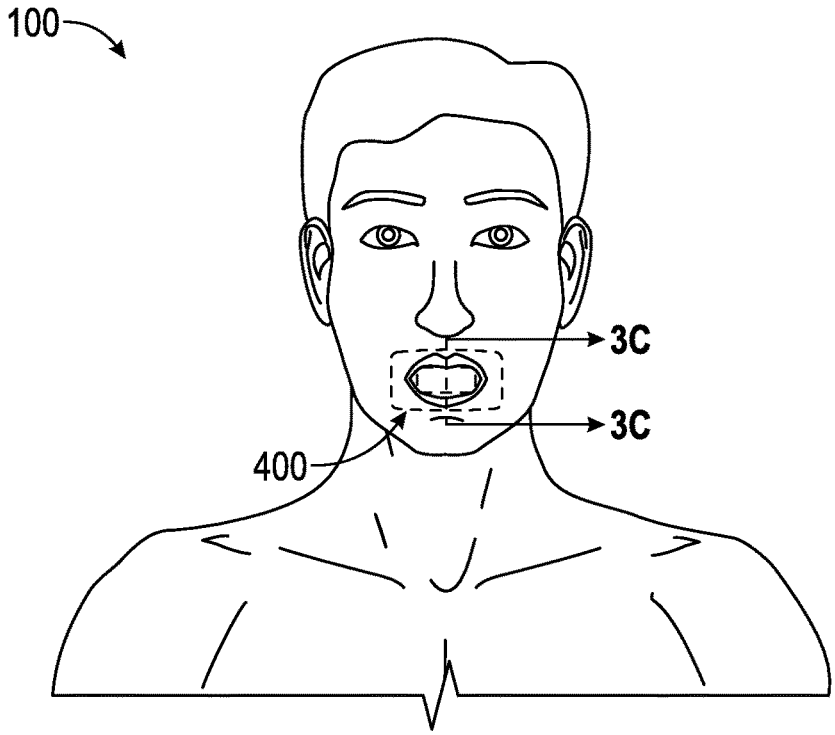
FIGS. 3A-3C illustrate an orally insertable member according to another embodiment.
Figure 3B:
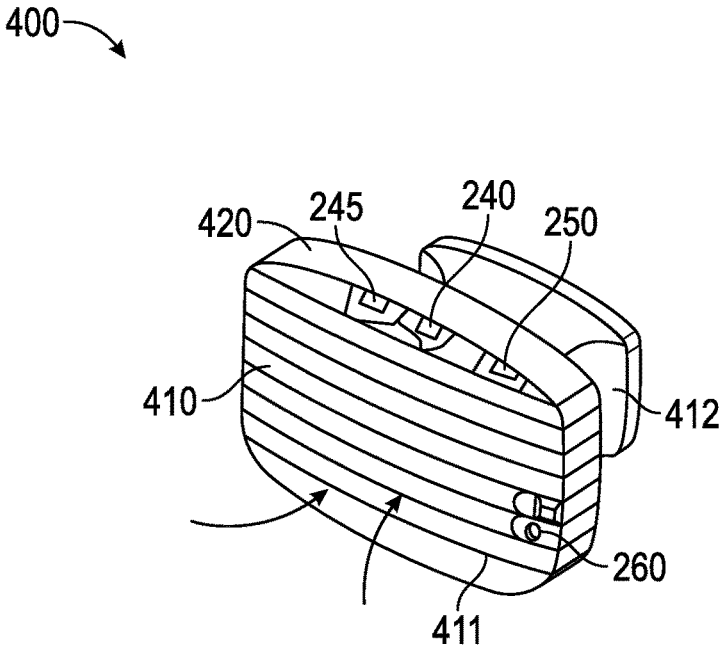
Figure 3C:
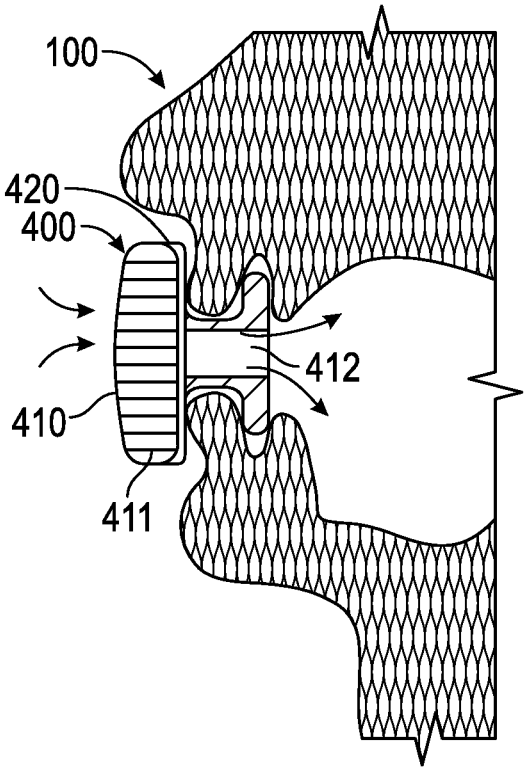

In another embodiment shown in FIGS. 3A-3C, an air filtering device in the form of insertable member 400 is shown removably coupled (e.g., inserted, implanted, etc.) to the mouth of user 100. Insertable member 400 may be removably coupled to an inside portion of the mouth of user 100, thereby creating an air tight seal between insertable member 400 and the mouth of user 100. In one embodiment, insertable member 400 includes seal 420 for sealingly engaging an outside surface of the face of user 100. Insertable member 400 includes air permeable filter member 410 having a plurality of filter layers 411. Insertable member 400 may further include mouthpiece 412 for removably coupling insertable member 400 to the mouth of user 100. In one embodiment shown in FIG. 3C, mouthpiece 412 is configured to be inserted into the mouth of user 100 between the lips and teeth along the gum line of user 100. In this manner, insertable member 400 is retained within the mouth of user 100 and can selectively filter/capture airborne particles entering the mouth of user 100.

Figure 4:
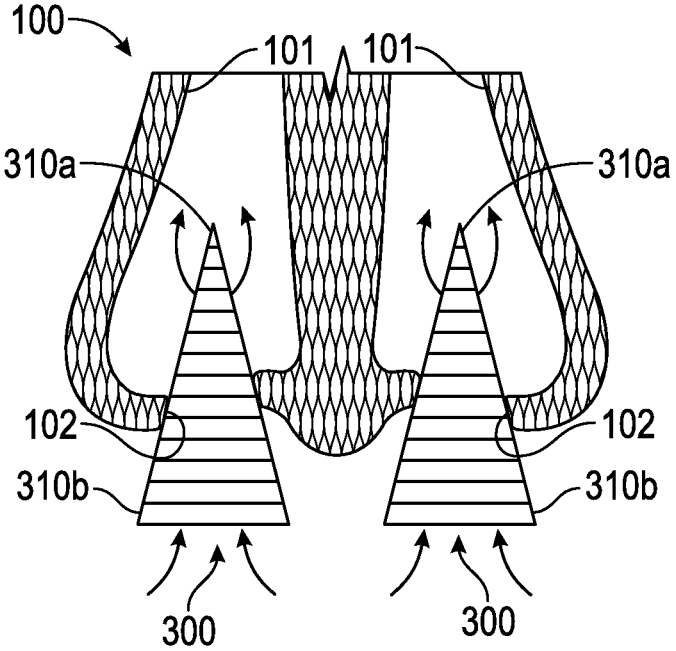
FIGS. 4-7 are cross-sections of the nasally insertable member of FIGS. 2A-2C shown inserted in a user's nasal cavity.
Figure 5:
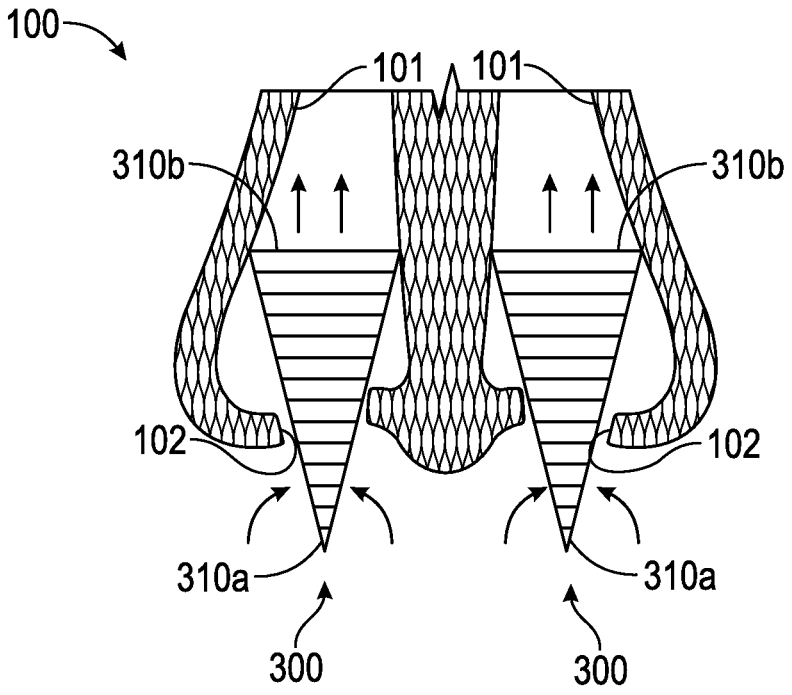
Figure 6:
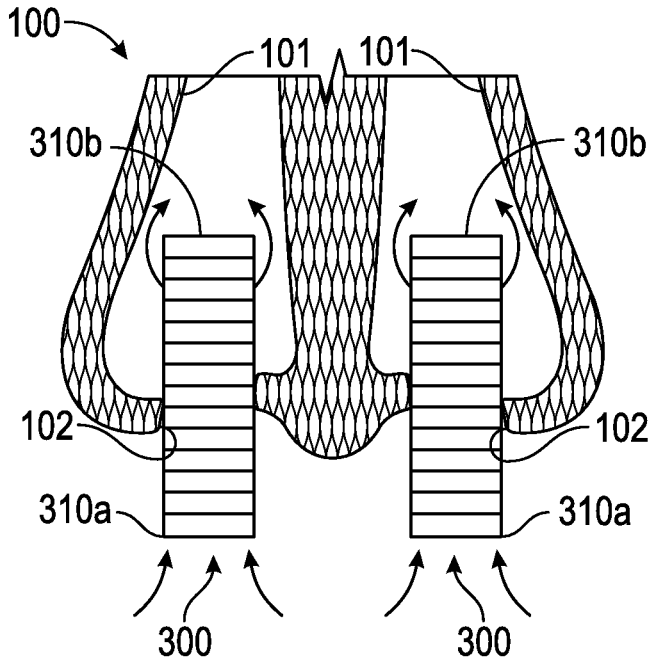

Referring now to FIGS. 4-7, various section views of the nose of user 100 are shown with a pair of insertable members 300 removably coupled therein. In the embodiments shown, the nose of user 100 includes inner walls 101 and entry walls 102. Each entry wall 102 defines an orifice or entryway to a nasal cavity of user 100. In the embodiments shown in FIGS. 4 and 6, insertable member 300 is retained in (e.g., coupled to) the nostril (e.g., nasal cavity) of user 100 at entry wall 102. Insertable member 300 can have a conical shape (as illustrated in FIG. 4), a cylindrical shape (as illustrated in FIG. 6), or can have a frusto-conical shape in which the proximal end 310*a* (e.g., the narrower end) is mostly or completely closed to airflow. In each of those embodiments, the distal end 310*b* (e.g., the outer end) is at least partially or fully open for air flow, and most or all of the air filtration occurs through the outside surface (i.e., the side wall). Distal end 310*b* is positioned toward the outside (e.g., exterior) of the nasal cavity and proximal end 310*a* is positioned inside (e.g., interior) of the nasal cavity. In some embodiments, distal end 310*b* protrudes outwardly from a user's nasal cavity. In other embodiments, distal end 310*b* is flush with, or at least partially inside, a front portion of a user's nasal cavity. A portion of insertable member 300 is in contact (e.g., engaged, coupled via a retaining member, etc.) with entry wall 102 such that insertable member 300 is retained within the nasal cavity. In this manner, an air flow (represented by arrows in FIGS. 4 and 6) can enter through distal end 310*b* and travel up through insertable member 300 and out through an outside surface located near proximal end 310*a* before traveling to the lungs of user 100.

Figure 7:
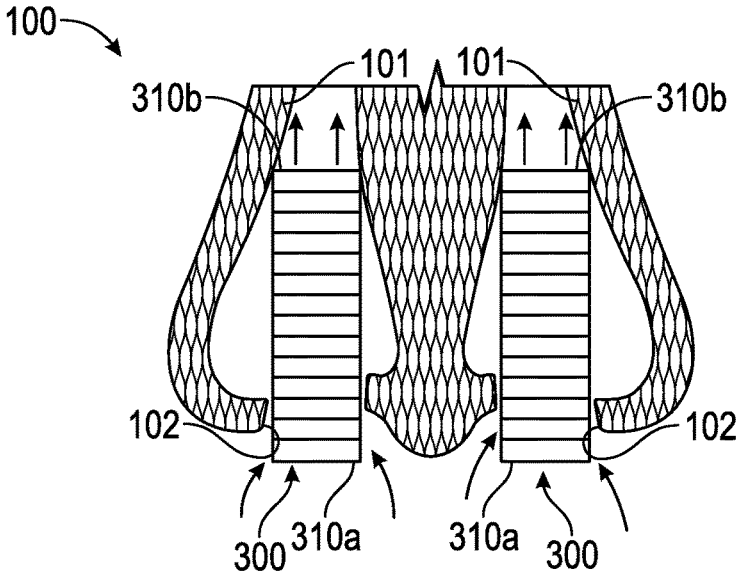

In another embodiment shown in FIGS. 5 and 7, insertable member 300 is retained in (e.g., coupled to) the nostril (e.g., nasal cavity) of user 100 at inner wall 101. Insertable member 300 can have a conical shape (as illustrated in FIG. 5), a cylindrical shape (as illustrated in FIG. 7), or can have a frusto-conical shape in which the proximal end 310*a* (e.g., the narrower end) is mostly or completely closed off from air flow. In each of those embodiments, the distal end 310*b* is fully or at least partially open to receive an airflow, and most or all of the air filtration occurs through the outside surface. Distal end 310*b* is positioned inside (e.g., interior) of the nasal cavity and proximal end 310*a* is positioned toward the outside (e.g., exterior) of the nasal cavity. In some embodiments, proximal end 310*a* protrudes outwardly from a user's nasal cavity. In other embodiments, proximal end 310*a* is flush with or at least partially inside the front of a user's nasal cavity. A portion of insertable member 300 is in contact (e.g., engaged, coupled via a retaining member, etc.) with inner wall 101 such that insertable member 300 is retained within the nasal cavity. In this manner, an air flow (represented by arrows in FIGS. 5 and 7) can enter through an outside surface near proximal end 310*a* and travel up through insertable member 300 and out through a surface located near distal end 310*b* before traveling to the lungs of user 100.

In the embodiments shown in FIGS. 1A-7, each of the filter members 210, 310, 410 may be an electrostatically-precipitating filter. The electrostatically-precipitating filter is configured to capture/precipitate airborne particles having a size of about 2.5 microns or less (e.g., PM 2.5 particulates). In other embodiments, the size of particles targeted for capture by the electrostatically-precipitating filter can be set to a different value, such as, for example, 3.5 microns, 1.5 microns, or other value. In various embodiments, each electrostatically-precipitating filter includes a plurality of filter layers 211, 311, 411 respectively. The plurality of filter layers 211, 311, 411 are configured to be selectively charged (e.g., activated) and/or discharged (e.g., deactivated) by respectively increasing and decreasing a voltage to thereby selectively control operation (e.g., filtering) of the electrostatically-precipitating filter. In some embodiments, the discharged state is implemented by completely removing the voltage (i.e., by reducing the applied voltage to zero). The electrostatically-precipitating filter (including the plurality of filter layers) are represented schematically in FIG. 1C at 211, shown depicted as a grid.

In one embodiment shown in FIGS. 1B-1C, 2B-2C, and 3B, each of the electrostatically-precipitating filters is operatively coupled to controller 250. Controller 250 is also configured to be connected to the Internet via wireless communication, such as Bluetooth technology. In one embodiment, controller 250 is a microcontroller (e.g., microprocessor) configured to automatically download and/or lookup available (e.g., published) information from a remote source, such as a mobile phone, laptop, or other similar device, relating to an ambient air pollution level (e.g., airborne particle count) for a given day. The information can correspond to a location where face mask 200 and/or insertable members 300, 400 will be used. Controller 250 may be further configured to selectively charge (i.e., activate) and/or discharge (i.e., deactivate) one or more of the plurality of filter layers 211, 311, 411 based on the ambient air pollution level obtained by controller 250. Each of the plurality of filter layers 211, 311, 411 is configured to be selectively charged by receiving a voltage via a control signal sent from controller 250. Each of the plurality of filter layers 211, 311, 411 that receives a voltage becomes electrically charged and is able to capture/precipitate airborne particles from an airflow entering the electrostatically-precipitating filter. Each of the plurality of filter layers 211, 311, 411 is also configured to be selectively discharged by decreasing an applied voltage via a control signal sent from controller 250. In this manner, the electrostatically-precipitating filter can actively/adaptively capture/precipitate airborne particles based on available (e.g., recorded, published, etc.) ambient air pollution levels (e.g., airborne particle counts). The details of the various methods for filtering air via controller 250 are discussed below with respect to FIGS. 10-13.

In another embodiment, controller 250 is configured to selectively charge a given surface area of each electrostatically-precipitating filter to control the amount/area of the filter being used to capture/precipitate airborne particles. Controller 250 is configured to charge a surface area based on (e.g., in response to, that corresponds to, etc.) ambient air pollution levels (e.g., airborne particle counts) available from a remote source. By way of example, if controller 250 determines that the ambient air pollution level for the day is going to be high (e.g., by looking up a published value from the Internet), controller 250 can charge a larger surface area of the electrostatically-precipitating filter for capturing/precipitating more airborne particles. By contrast, if controller 250 determines that the ambient air pollution level for the day is going to be low, controller 250 can charge a smaller surface area of the electrostatically-precipitating filter. In this manner, the electrostatically-precipitating filter can actively adjust to capture/precipitate airborne particles based on published ambient air pollution levels without using (i.e., charging) an unnecessary amount/surface area of the filter, thereby prolonging the useful life of the filter.

In other embodiments, selective charging and discharging of the plurality of filter layers 211, 311, 411 and/or the given surface area of the electrostatically-precipitating filter can vary between when a user inhales (i.e., takes in air) and when a user exhales (i.e., expels air). For example, when a user inhales, it may be advantageous to increase the number of charged filter layers 211, 311, 411 and/or surface area to increase the number of airborne particles captured/precipitated. By contrast, when a user exhales, little or no air is being introduced into a user's lungs. Thus, it may be advantageous to decrease the number of charged filter layers 211, 311, 411 and/or surface area of the electrostatically-precipitating filter.

In another embodiment shown in FIGS. 1B-1C, 2B-2C, and 3B, face mask 200 and insertable members 300, 400 each include sensor 240 operatively coupled to the electrostatically-precipitating filter. Sensor 240 is also operatively (e.g., electrically) coupled to controller 250 and is configured to detect an airflow condition proximate to the filter, and to transmit a corresponding signal to controller 250. Controller 250 is configured to receive the signal and to perform an operation in response to the signal, such as transmitting data to electronic communication device 265 (e.g., mobile phone, laptop, tablet, etc.), transmitting data to memory 255, and/or selectively controlling (e.g., charging and discharging) filter layers 211, 311, 411 and/or a surface area of the electrostatically-precipitating filter.

In one embodiment, sensor 240 is configured to detect a condition relating to a total number (e.g., an estimated amount) of airborne particles entering or leaving the electrostatically-precipitating filter, such as determining when a volume (e.g., a value indicative of an airborne particle amount) of captured airborne particles reaches a predetermined (e.g., threshold) value/amount. In another embodiment, sensor 240 is configured to detect a condition relating to a characteristic of airborne particles entering or leaving the electrostatically-precipitating filter. In various embodiments, sensor 240 can detect different characteristics of airborne particles such as concentration of airborne particles, type of airborne particles, and/or size distribution of airborne particles entering or leaving the electrostatically-precipitating filter. For example, an increase in the concentration of targeted airborne particles (e.g., PM2.5 particles) entering the electrostatically-precipitating filter can indicate a need to increase filtration. In another example, an increase in concentration of targeted airborne particles (e.g., PM2.5 particles) leaving the electrostatically-precipitating filter can indicate insufficient filtration, and hence a need to increase filtration.

In one embodiment, controller 250 is configured to transmit a signal corresponding to the detected characteristic and/or condition to thereby selectively charge and/or discharge one or more filter layers 211, 311, 411 and/or a surface area of the electrostatically-precipitating filter. In another embodiment, controller 250 is configured to transmit a signal corresponding to the detected characteristic and/or condition to electronic communication device 265, such as a mobile phone, laptop, tablet, or similar device via wireless communication, such as Bluetooth technology. The transmitted information may be retrieved by a user to assess the status (e.g., cleanliness) and/or effectiveness of the electrostatically-precipitating filter.

Figure 1C:
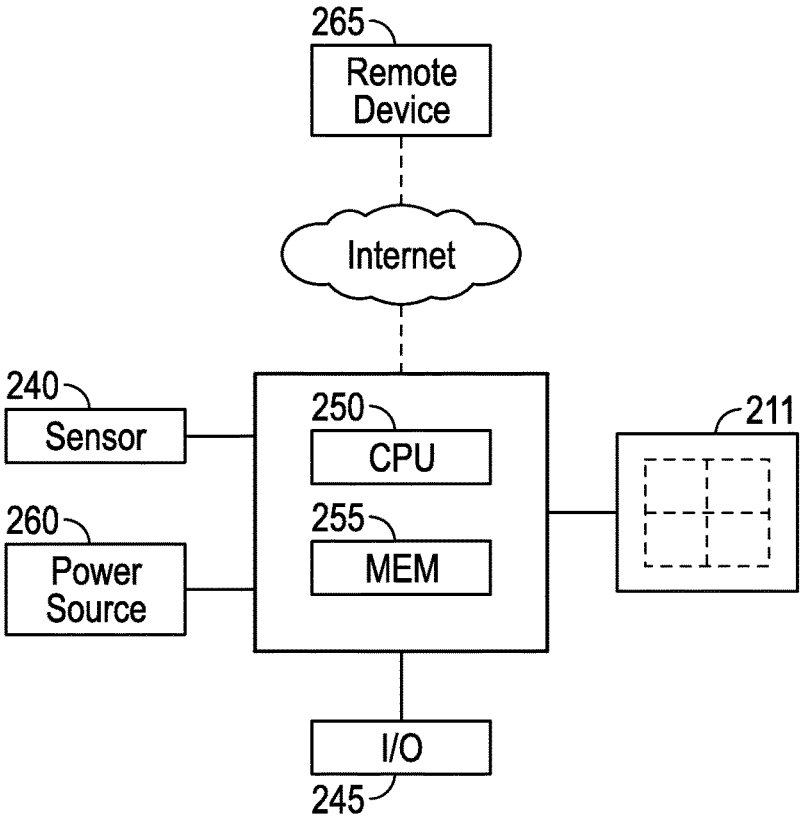
FIG. 1C is a schematic of an electrical system for an air filter device according to one embodiment.

In the embodiment shown in FIG. 1C, controller 250 includes memory 255 configured to store information relating to a detected condition of the electrostatically-precipitating filter. For example, in one embodiment, controller 250 is configured to store information in memory 255 relating to an amount/volume of airborne particles captured/precipitated in a given time period. In another embodiment, controller 250 is configured to store information in memory 255 that corresponds to ambient (e.g., surrounding) air pollution levels (e.g., an ambient airborne particle count). In each of the various embodiments, controller 250 is configured to transmit a corresponding signal via wireless communication to an electronic communication device for a user to retrieve the stored data. In other embodiments, the transmitted signal can also include data relating to a time period for when the condition was detected and/or a location of where the condition was detected. The transmitted signal/information may provide a user with an indication of the cleanliness of the electrostatically-precipitating filter, the number/amount of particles filtered, and/or the ambient air conditions of when and where the electrostatically-precipitating filter was used.

Figure 8:
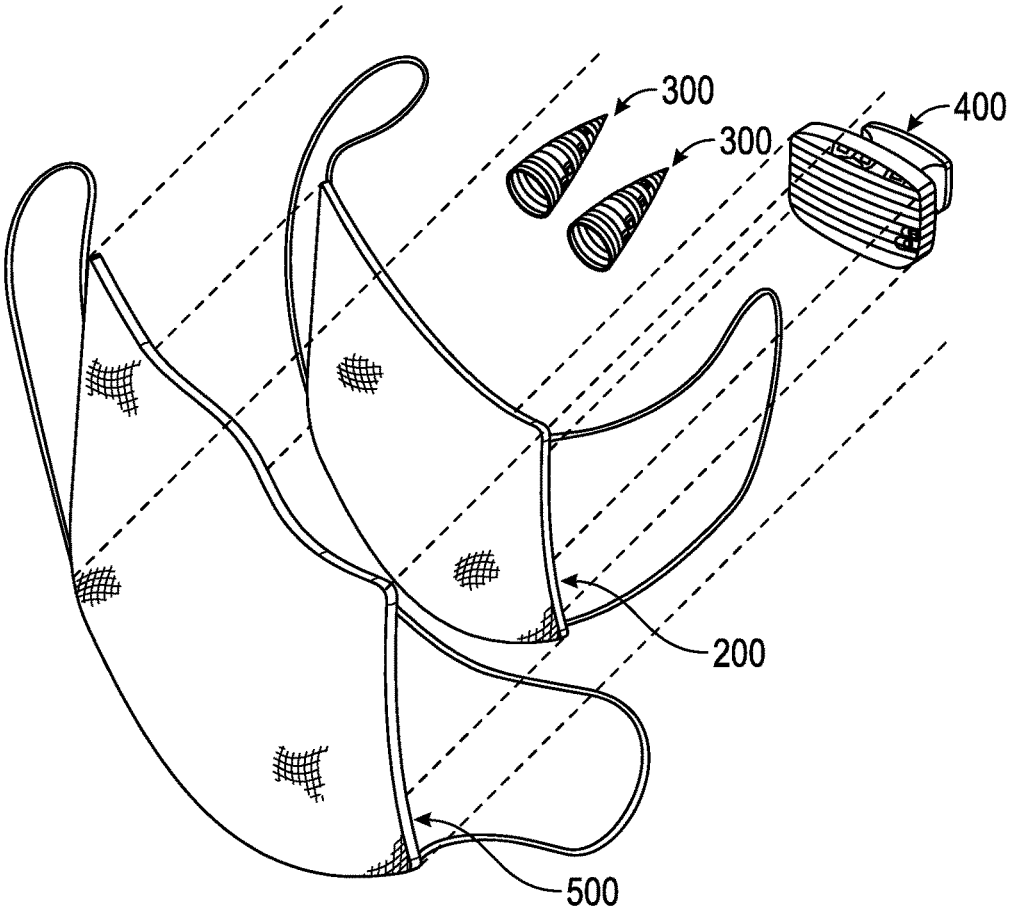
FIG. 8 is an exploded assembly view of multiple air filtering devices according to another embodiment.
Figure 9:
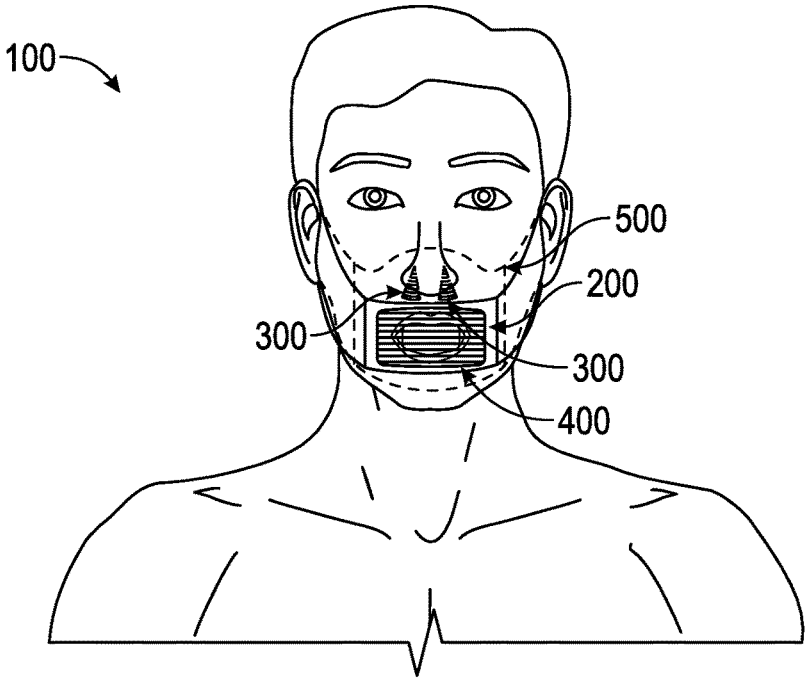
FIG. 9 is a front view of a user wearing the multiple air filtering devices of FIG. 8.
Figure 10:
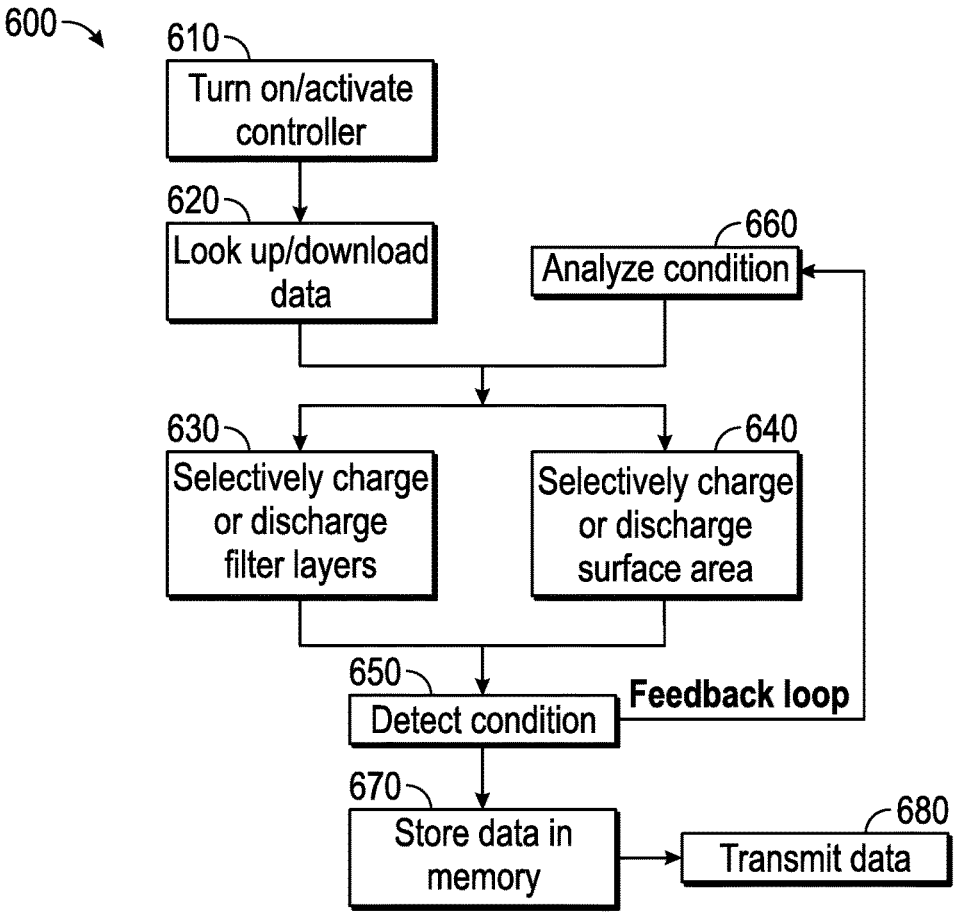
FIGS. 10-13 are block diagrams illustrating methods for filtering air according to various embodiments.

In another embodiment shown in FIGS. 8-9, face mask 200 and/or insertable members 300, 400 each include pre-filter member 500 (e.g., a second filter member) positioned adjacent to face mask 200 and/or insertable members 300, 400. In one embodiment, pre-filter member 500 is removably coupled to face mask 200. In each of the embodiments shown, pre-filter member 500 is configured to capture/filter airborne particles having a size greater (e.g., larger) than about 2.5 microns (or whichever airborne particle size target value the electrostatically-precipitating filter is designed for) to thereby prevent the electrostatically-precipitating filter from getting clogged (e.g., filled) with large airborne particles (e.g., particles larger than 2.5 microns). In one embodiment, pre-filter member 500 is removably coupled to a front surface of face mask 200 to operate as a pre-filter when a user inhales (i.e., takes in air). In yet another embodiment (not shown), pre-filter member 500 is removably coupled to both a front and a rear surface of face mask 200. In each of the above embodiments, pre-filter member 500 is configured to be removable such that a user can clean and/or replace pre-filter member 500.

In another embodiment, controller 250 is configured to selectively control filtering between pre-filter member 500 and the electrostatically-precipitating filter(s) based on a user's breathing effort. In various embodiments, pre-filter member 500 is a high efficiency particulate air (HEPA) filter. Pre-filter member 500 is configured to allow for less breathing effort from a user than with the electrostatically-precipitating filter, due to the difference in filtering capabilities of each filter (e.g., the size of airborne particles that can be filtered by each filter). For example, when a user is expending a large amount of effort to breathe, controller 250 can sense the user's breathing effort (e.g., via sensor 240 or other suitable sensor) and can switch from filtering/precipitating by the electrostatically-precipitating filter (e.g., by powering off and/or decreasing power to the electrostatically-precipitating filter) to filtering by pre-filter member 500. In this manner, face mask 200 and/or insertable members 300, 400 can adapt to a user's breathing effort while still filtering/capturing airborne particles.

In another embodiment, controller 250 is configured to provide an indication to a user to breathe through their nose and/or mouth depending on a detected condition of the electrostatically-precipitating filter detected by sensor 240. Controller 250 may be configured to provide an indication through input/output device 245, such as through a sound indicator (e.g., bell, horn, etc.) or a visual indicator (e.g., LED, light bulb, etc.), of when a user should switch from breathing through their mouth to breathing through their nose or vice versa, depending on which air filter device or combination of air filter devices are being used. For example, if a user is only using insertable member 300 to filter airborne particles and controller 250 determines that the ambient airborne particle count is abnormally high (e.g., above a threshold airborne particle value), controller 250 may provide an indication to user 100 to only breath through their nose, such that the user does not inhale unfiltered air through their mouth. In this manner, controller 250 helps to protect users from inadvertently inhaling dangerous/abnormal levels of airborne particles.

In various embodiments, controller 250 and/or sensor 240 are each configured to be powered at least in part by an airflow passing through face mask 200 and insertable members 300, 400 respectively. Face mask 200 and insertable members 300, 400 may be configured to harvest the energy from the airflow to provide a voltage sufficient to operate controller 250 and/or sensor 240. In another embodiment shown in FIGS. 1B-1C, 2B-2C, and 3B, face mask 200 and insertable members 300, 400 each include a power source in the form of battery 260. Battery 260 is operatively coupled to controller 250 and/or sensor 240 to provide power thereto. In other embodiments (not shown), face mask 200 and insertable members 300, 400 each include a power source in the form of a solar cell configured to provide solar power to controller 250 and/or sensor 240.

In the various embodiments described herein, controller 250 may be implemented as a general-purpose processor, an application specific integrated circuit (ASIC), one or more field programmable gate arrays (FPGAs), a digital-signal-processor (DSP), a group of processing components, or other suitable electronic processing components. Memory 255 is one or more devices (e.g., RAM, ROM, Flash Memory, hard disk storage, etc.) for storing data and/or computer code for facilitating the various processes described herein. Memory 255 may be or include non-transient volatile memory or non-volatile memory. Memory 255 may include database components, object code components, script components, or any other type of information structure for supporting the various activities and information structures described herein. Memory 255 may be communicably connected to controller 250 and provide computer code or instructions to controller 250 for executing the processes described herein.

Referring now to FIGS. 10-13, various methods for actively filtering airborne particles are shown. In one embodiment shown in FIG. 10, method 600 configured to be executed by controller 250 is shown. An activation signal to power on an air filter device is received (610). In one embodiment, the activation signal is received by controller 250. Controller 250 automatically retrieves/obtains an available ambient air pollution level (e.g., airborne particle count) for a particular day from a remote source via wireless communication (620). In one embodiment, the wireless communication is Bluetooth technology. Based on the available air pollution level, controller 250 transmits a signal to the electrostatically-precipitating filter to selectively charge a corresponding number of filter layers 211, 311, 411, to thereby selectively capture/precipitate ambient airborne particles (630). In another embodiment, controller 250 selectively charges a given surface area of the electrostatically-precipitating filter based on the obtained ambient air pollution level (640).

In another embodiment, method 600 further includes detecting an airflow condition proximate to the electrostatically-precipitating filter (650). As previously discussed, conditions detected by sensor 240 can include an amount of ambient airborne particles captured/precipitated, an amount of ambient airborne particles captured/precipitated in a given time period, and/or a characteristic of ambient airborne particles entering or leaving the electrostatically-precipitating filter. Characteristics of airborne particles may include a concentration of airborne particles, type of airborne particles, and/or the size distribution of airborne particles encountered by the electrostatically-precipitating filter. In one embodiment, after a condition of the electrostatically-precipitating filter is detected, sensor 240 transmits a corresponding signal to controller 250 via a feedback loop (650). Controller 250 analyzes the detected condition and determines whether to selectively charge or discharge one or more filter layers 211, 311, 411, and/or a different surface area of the electrostatically-precipitating filter (630, 640).

For example, if controller 250 determines that there is an increase in the amount of airborne particles (based on the detected condition) that is above the amount/value obtained at step 650, then controller 250 will transmit a corresponding signal to increase the number of charged filter layers 211, 311, 411 and/or charged surface area of the electrostatically-precipitating filter (660). By contrast, if controller 250 determines that there is a decrease in the amount of airborne particles (based on the detected condition) below the amount/value obtained, then controller 250 will transmit a corresponding signal to decrease the number of charged filter layers 211, 311, 411 and/or charged surface area of the electrostatically-precipitating filter. In this manner, method 600 allows for active (e.g., adaptive) filtering of face mask 200 and/or insertable members 300, 400.

In another embodiment, method 600 includes transmitting information relating to a detected condition (650) to memory 255 (670). Method 600 may further include transmitting the information that is stored in memory 255 to an electronic communication device (680), such as a smartphone, laptop, tablet, or other similar device, such that a user can later retrieve the transmitted information. In various embodiments, the stored information is transmitted to an electronic communication device via wireless communication, such as Bluetooth technology.

Figure 11:
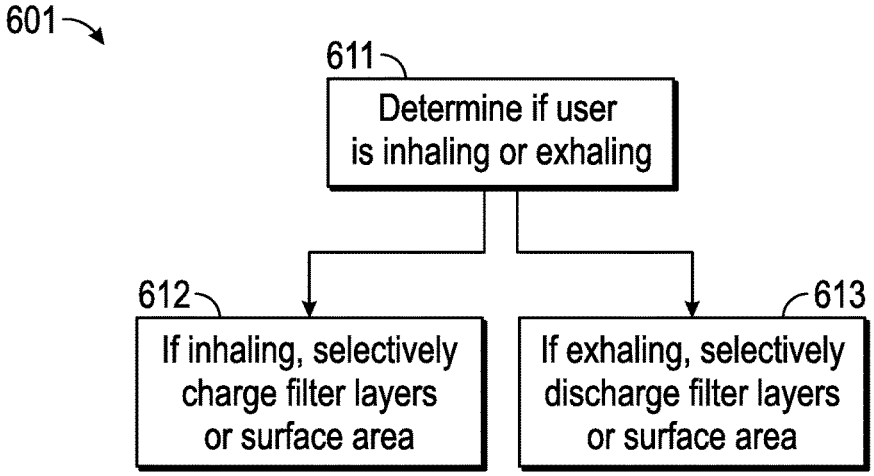

In another embodiment shown in FIG. 11, method 601 includes determining whether a user is inhaling or exhaling to provide for further control of face mask 200 and/or insertable members 300, 400. As shown in FIG. 11, controller 250 determines whether a user is inhaling or exhaling via sensor 240 or other suitable sensing device (611). If controller 250 determines that the user is inhaling, then controller 250 will selectively charge a corresponding number of filter layers 211, 311, 411 or a corresponding surface area of the electrostatically-precipitating filter (612). By contrast, if controller 250 determines that the user is exhaling, then controller 250 will selectively discharge a corresponding number of filter layers 211, 311, 411 or a corresponding surface area of the electrostatically-precipitating filter (613). In this manner, method 601 can selectively control filtering by the electrostatically-precipitating filter based on whether a user is inhaling or exhaling.

Figure 12:
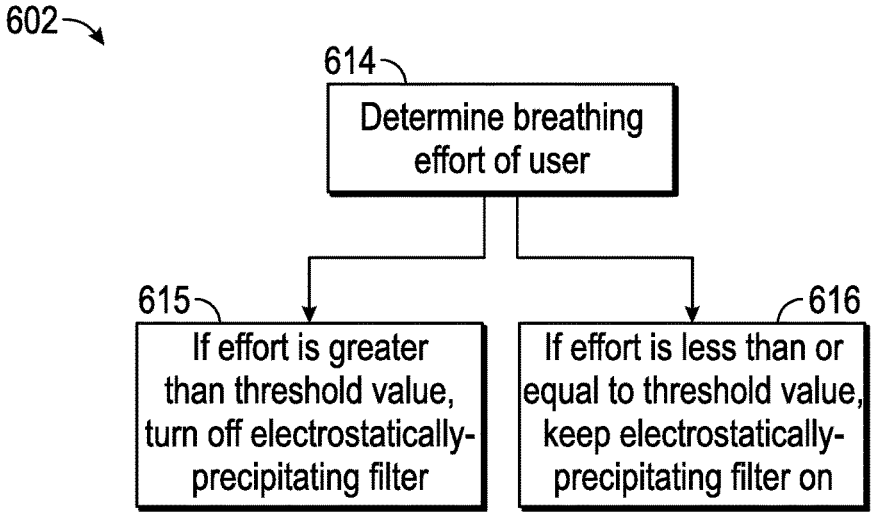

In another embodiment shown in FIG. 12, method 602 includes selectively controlling the electrostatically-precipitating filter based on a user's breathing effort. Controller 50 determines via sensor 240 or other suitable sensing device, a user's breathing effort (614). The user's breathing effort may correspond to an air flow rate value or other value indicative of a user's breathing effort. If the determined breathing effort is greater than a pre-defined threshold value (e.g., pre-programmed or user programmed value), then controller 250 transmits a signal to either turn off (e.g., power off) or reduce an amount of power supplied to the electrostatically-precipitating filter (615), thereby enabling a user to breath more freely/easily. By contrast, if the determined breathing effort is less than or equal to the pre-defined threshold value, then controller 250 transmits a signal to keep supplying power to the electrostatically-precipitating filter (615). In this manner, face mask 200 and/or insertable members 300, 400 can adapt to a user's breathing effort.

Figure 13:
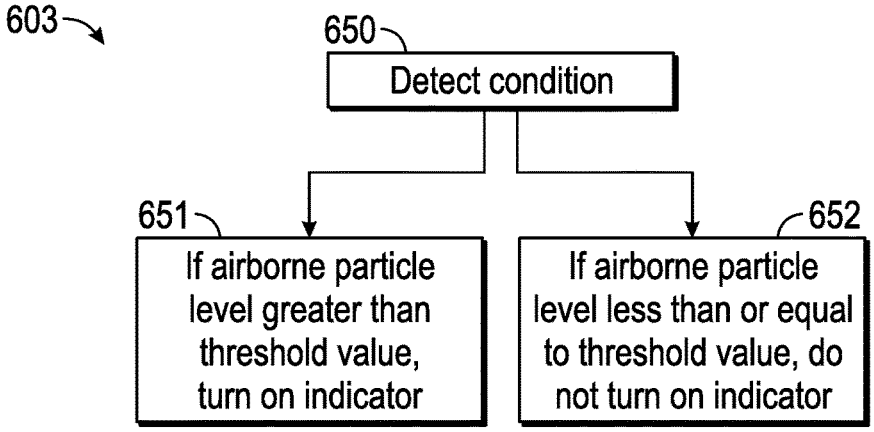

In another embodiment shown in FIG. 13, method 603 includes providing an indication to a user to breathe through their nose and/or mouth depending on a detected condition of the electrostatically-precipitating filter (650). Controller 250 may be configured to provide an indication, such as by activating input/output device 245, such as a sound or light indicator, of when a user should switch from breathing through their mouth to breathing through their nose or vice versa, depending on which air filter device or combination of air filter devices are being used. In the embodiment shown, if sensor 240 determines that the ambient airborne particle level is greater than a pre-defined threshold value (e.g., a pre-programmed value or a user programmed value) (651), then controller 250 transmits a signal to turn on (e.g., activate) an indicator. Alternatively, if sensor 240 determines that the airborne particle level is less than or equal to the pre-defined threshold value (652), then controller 250 transmits a signal to leave the indicator off. The indicator can provide the user with an alert or notice that indicates to a user that it is time to breathe through either their nose or mouth depending on which air filter device is being used (e.g., face mask 200 or insertable members 300, 400).

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A face mask, comprising:

an electrostatically-precipitating filter configured to be removably coupled to a face of a user;

a controller operatively coupled to the electrostatically-precipitating filter; and a fastening member configured to removably couple the electrostatically-precipitating filter to the face of the user;

wherein the controller is configured to selectively control operation of the electrostatically-precipitating filter in response to an input received by the controller.

2. The face mask of claim 1, wherein the electrostatically-precipitating filter includes a plurality of filter layers.

3. The face mask of claim 1, wherein the input is indicative of at least one of an ambient air pollution level and an airflow condition proximate the electrostatically-precipitating filter.

4. The face mask of claim 2, wherein the controller is configured to selectively charge one or more of the plurality of filter layers to increase precipitation of the electrostatically-precipitating filter in response to the input.

5. The face mask of claim 2, wherein the controller is configured to selectively discharge one or more of the plurality of filter layers to decrease precipitation of the electrostatically-precipitating filter in response to the input.

6. The face mask of claim 2, wherein each of the plurality of filter layers is selectively charged or discharged by increasing or decreasing a voltage respectively.

7. The face mask of claim 6, wherein the controller is configured to selectively charge or discharge the plurality of filter layers based on whether a user is inhaling or exhaling.

8. The face mask of claim 1, wherein the controller is configured to selectively charge or discharge a surface area of the electrostatically-precipitating filter to respectively increase or decrease precipitation of the electrostatically-precipitating filter in response to the input.

9. The face mask of claim 1, wherein the input includes a value obtained wirelessly from a remote source.

10. The face mask of claim 3, further comprising a sensor operatively coupled to the electrostatically-precipitating filter and the controller, wherein the sensor is configured to detect the airflow condition proximate the electrostatically-precipitating filter and to transmit as the input a signal relating to the airflow condition to the controller.

11. The face mask of claim 10, wherein the airflow condition includes a value indicative of an amount of airborne particles entering the electrostatically-precipitating filter.

12. The face mask of claim 10, wherein the airflow condition includes a characteristic of airborne particles entering the electrostatically-precipitating filter.

13. The face mask of claim 12, wherein the characteristic includes at least one of particle concentration, particle type, and particle size distribution.

* * * * *